US005949303A

United States Patent [19]

Arvidsson et al.

[11] Patent Number: 5,949,303

[45] Date of Patent: Sep. 7, 1999

[54] MOVABLE DIELECTRIC BODY FOR CONTROLLING PROPAGATION VELOCITY IN A FEED LINE

[75] Inventors: Per-Anders Arvidsson; Stefan Andersson, both of Stockholm, Sweden

[73] Assignee: Allgon AB, Akersberga, Sweden

[21] Appl. No.: 08/750,714

[22] PCT Filed: May 24, 1996

[86] PCT No.: PCT/SE96/00678

§ 371 Date: Dec. 17, 1996

§ 102(e) Date: Dec. 17, 1996

[87] PCT Pub. No.: WO96/37922

PCT Pub. Date: Nov. 28, 1996

[30] Foreign Application Priority Data

May 24, 1995 [GB] United Kingdom ..... 9501955-0

[51] Int. Cl.[6] ..... H01P 1/18

[52] U.S. Cl. ..... 333/136; 333/156; 333/161; 343/853

[58] Field of Search ..... 333/161, 156, 333/139, 136; 343/853

[56] References Cited

U.S. PATENT DOCUMENTS

| | | | |
|---|---|---|---|
| 2,831,169 | 4/1958 | Casal | 333/156 X |
| 3,440,573 | 4/1969 | Butler | 333/156 X |
| 3,656,179 | 4/1972 | De Loach | 333/161 |
| 4,356,462 | 10/1982 | Bowman | 333/161 X |
| 5,126,705 | 6/1992 | Carnevali et al. | 333/128 |

FOREIGN PATENT DOCUMENTS

| | | | |
|---|---|---|---|
| 0618639 | 10/1994 | European Pat. Off. . | |
| 2947987 | 9/1981 | Germany . | |
| 3113452 | 11/1982 | Germany | 333/161 |
| 117801 | 7/1984 | Japan | 333/161 |

OTHER PUBLICATIONS

Patent Abstracts of Japan, abstract of JP–A–62–196903 (Matsushita Electric Works Ltd), Aug. 31, 1987.

Patent Abstracts of Japan, abstract of JP–A–63–296402 (Mitsubishi Electric Corp), Dec. 2, 1988.

*Primary Examiner*—Benny T. Lee

*Attorney, Agent, or Firm*—Jacobson, Price, Holman & Stern, PLLC

[57] ABSTRACT

A feed line structure (1), especially integrated with a stationary array of antenna elements so as to enable adjustment of the direction of the beam radiated from the array. The feed line structure comprises a feed conductor line pattern (3) disposed on a fixed carrier plate (2) at a distance from and in parallel to a fixed ground plate (4), and a movable dielectric plate (5) located therebetween. The feed line pattern (3) is elongated in the same direction (A) as the movement direction of the dielectric plate (5). The propagation velocity of the signal components is reduced by the dielectric plate (5), whereby a controlled phase difference between the various signal components is obtained.

11 Claims, 2 Drawing Sheets

1
2
3
4
5
6
7
8
9
10
11
12
13
13'
14
14'
T1
T2
T3
T4
A
IV
IV
31
32
33
34
35
35
36
37
38
39

MOVABLE DIELECTRIC BODY FOR CONTROLLING PROPAGATION VELOCITY IN A FEED LINE

BACKGROUND OF THE INVENTION

The present invention concerns a device for adjusting the beam direction of a beam radiated from a stationary array of antenna elements, wherein at least two antenna element feed points are coupled to a common signal source via a feed line structure having a source connection terminal to be connected to said source and at least two feed connection terminals to be connected to said antenna element feed points, the feed line structure comprising a feed conductor line pattern disposed in a fixed planar arrangement, e.g. on a carrier plate, at a distance from and in parallel to a fixed ground plate, and a movable dielectric body located therebetween, said movable dielectric body being displaceable in parallel to the feed conductor line pattern and the ground plate so as to change the exciting phase of a signal component reaching one of the feed connection terminals. The invention also concerns a feed line structure for use in an antenna or any other device requiring a controlled adjustment of the phase difference between at least two signal components derived from a radio frequency signal generated by a common source.

A device of the kind referred to above is previously known from JP, A, 63296402. A number of triangular dielectric bodies are movable in two perpendicular directions, in each case transversely to a conductor line segment so as to enable a controlled delay of the corresponding signal component. The delay is substantially proportional to the surface portion of the triangle being in registry with the associated conductor line segment. In this way, the beam can be adjusted in two mutually perpendicular directions.

However, each triangular body has relatively small dimensions in relation to the length of each conductor line leading to a feed connection terminal. Therefore, the adjustment possibilities are rather limited. Furthermore, in case such triangular bodies with larger dimensions were to be used, the impedance of the feed line structure would be adversely affected.

OBJECTS OF THE INVENTION

Against this background, it is a primary object of the present invention to achieve an adjustment device, which enables a substantial phase shift while keeping the input impedance at the source connecting terminal essentially unchanged.

Another object is to achieve a feed line structure, which is easy to manufacture and convenient to operate, in particular by means of a manual control means.

SUMMARY OF THE INVENTION

Thus, according to the invention, the feed line pattern is elongated in a main direction and includes longitudinal feed line segments extending in parallel to the main direction towards each one of the feed connection terminals. The dielectric body is formed substantially as a dielectric plate, which is displaceable in the main direction between two end positions. Furthermore, the dielectric plate is dimensioned and located so as to extend in a region covering overlapping portions of the longitudinal feed line segments. In this way, these overlapping portions will effect a well-defined propagation velocity reduction of the corresponding signal components before they reach the respective feed connection terminals.

Since the dielectric plate is movable in the same direction as the extension of the longitudinal feed line segments (the main direction), the propagation velocity reduction will be very distinct and easy to control by mechanically controlling the linear movement of the dielectric plate between the two end positions. Preferably, the dielectric plate is continuously displaceable so as to be positioned in any desired location. In this way, the beam direction can be adjusted accordingly.

Preferably, the source connection terminal is located at a central portion of the feed line pattern, whereas the feed connection terminals are located at opposite end portions of the pattern. The dielectric plate then extends in a region also covering the central portion of the feed line pattern and it will normally have a relatively large area corresponding to at least half of the surface area of the carrier plate (or the outer contour of the feed line pattern).

In a preferred embodiment, the dielectric plate is substantially rectangular, and the feed conductor line pattern is meander-shaped. Moreover, because of the elongated structure of the meander-shaped pattern, the longitudinal feed line segments constitute a major part of the total length of the feed line segments in the feed conductor line pattern.

In principle, there could be only two feed connection terminals, one at each end of a straight conductor line. However, most preferably, the feed conductor line pattern includes several meander-shaped portions with loops being branched off from each longitudinal feed line segment and including at least two further longitudinal feed line segments.

With such a meander-shaped configuration, it is possible to keep a predetermined relation between the phase angles of the various signal components, irrespective of the particular position of the dielectric plate.

Preferably, the dielectric plate is displaceable by means of a mechanical actuator coupled to a manually operable control means, e.g., a control knob on a rotatable axis coupled via a gear mechanism to a longitudinally guided rack, which is secured to the dielectric plate.

Further details and modifications of the feed line structure will appear from the detailed description below, reference being made to the drawings.

DETAILED DESCRIPTION OF THE PREFERRED EMBODIMENTS

According to the main aspect of the invention, an especially designed feed line structure is integrated in an antenna device for adjusting the direction of a beam radiated from a stationary array of antenna elements. The adjustment is achieved by controlling the respective phase angles of the signal components reaching the respective antenna element. In case the antenna elements are positioned along a vertical row, and there is a constant phase difference between adjacent antenna elements, the resulting beam will be directed or tilted correspondingly, as is well known per se in the art. The present invention relates to the feed line structure that makes such an adjustment possible.

Figures 1, 3, 4:
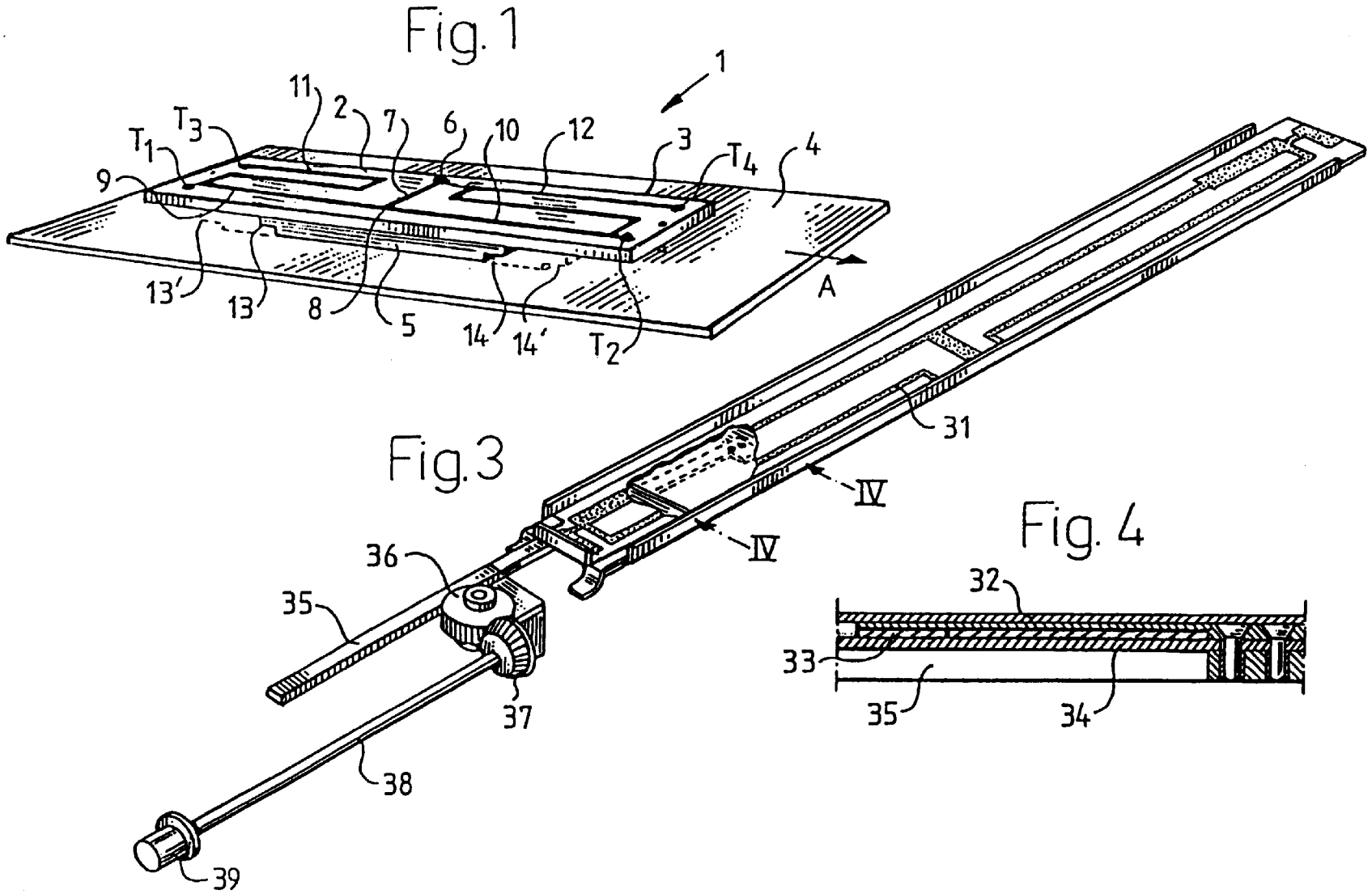
FIG. 1 shows schematically, in a perspective view, a feed line structure according to the invention.
FIG. 3 shows, in a perspective view, a device according to the invention, including a mechanical actuator illustrated schematically.
FIG. 4 shows, to a larger scale, a partial longitudinal section along the lines IV—IV in FIG. 3.

In FIG. 1 there is schematically shown a feed line structure 1, which is generally flat and which comprises an upper, stationary carrier plate 2 with a feed conductor line pattern 3 deposited thereon, a stationary bottom plate 4, serving as a ground plane, and a movable dielectric plate 5 located therebetween. The carrier plate 2 is made of a dielectric material, whereas the bottom plate 4 is made of a electrically conducting material, e.g. a metal such as aluminum.

The feed conductor line pattern has a generally rectangular, elongated outer contour, normally even more elongated than indicated schematically in FIG. 1. The direction of elongation is indicated in FIG. 1 by an arrow A, which coincides with the movement direction of the movable intermediate plate 5.

In the central portion of the feed conductor line pattern, there is a source connection terminal 6 to which a signal transmission line from a common source is to be connected. The source connection terminal 6 is followed by a transversal, relatively short conductor line segment 7 ending in a junction point 8, from which two longitudinally extending feed line segments 9 and 10 depart in opposite directions in parallel to the main direction A. At the respective far ends of these longitudinal feed line segments 9 and 10, there are feed line terminals $T_1$ and $T_2$ intended to be connected to respective feed points of associated antenna elements.

Adjacent to these feed connection terminals $T_1$ and $T_2$, meander-shaped loops 11 and 12 are branched off so as to form continued feed conductor line segments, including two relatively long segments extending in parallel to the main direction A. The meander-shaped loops 11 and 12 end at respective feed connection terminals $T_3$ and $T_4$ intended to be connected to associated antenna element feed points.

The movable dielectric plate 5 has a width corresponding to the width of the carrier plate 2 and a length approximately corresponding to half the length of the carrier plate. At each transversal, shorter side edge, there is a step-like recess 13 and 14, respectively, which is dimensioned so as to minimize reflection of the radio wave energy propagating along the feed conductor line segments 9, 10, 11 and 12.

In the centrally located position of the dielectric plate 5, drawn by full lines in FIG. 1, the energy or signal propagation velocity will be symmetrical with respect to the central transversal conductive line segment 7. The dielectric plate 5 fills the air gap between the carrier plate 2 and the ground plate 4. Therefore, the propagation velocity will be slightly lower in those portions of the conductive line segments lying above the plate 5, due to the dielectric material between the conductive line and the ground plate.

When the plate 5 is displaced in the main direction A, e.g., to an end position corresponding to the dotted lines 14', the signal components propagating along the conductor line segments 10 and 12 will be delayed, more so at the feed connection terminal $T_4$ than at the feed connection terminal $T_2$, whereas the signal components propagating along the conductor line segments 9 and 11 will run slightly ahead, more so at the feed connection terminal $T_3$ than at the feed connection terminal $T_1$. On the other hand, when the plate 5 is moved in the opposite direction, to the end position indicated by the dotted lines 13', the reverse conditions will prevail, i.e. the signal components propagating along the conductor line segments 9 and 11 will be delayed, whereas the signal components propagating along the conductor line segments 10 and 12 will run ahead.

Because of the geometrical configuration, the phase angle differences between the signal components at feed connection terminals $T_4$, $T_2$, $T_1$ and $T_3$ will always be the same, irrespective of the particular position of the dielectric plate 5. In particular, assume that the end position 13' corresponds to an exactly horizontal direction of the composite beam radiated from four antenna elements connected to the terminals $T_1$ through $T_4$. When the plate 5 is displaced a certain increment in the direction A, the signal components at the four terminals will be delayed, e.g., with phase angle shifts of 15°, 5°, −5° and −15° (in the order $T_4$, $T_2$, $T_1$ and $T_3$) . Then, upon a further incremental displacement, the angle shift will be, e.g., 30°, 10°, −10° and −30°. So, the phase angle differences between adjacent terminals will always be the same. Accordingly, the composite beam from the four antenna elements will always have a wave front in the form of a straight line. With increasing angular phase differences, the inclination of this wave front line will increase, and the beam will be gradually tilted downwards.

Clearly, it is a great advantage that the uniform phase angle difference between the various feed connection terminals will be maintained in the course of a simple linear movement of the dielectric plate 5.

Figure 2:
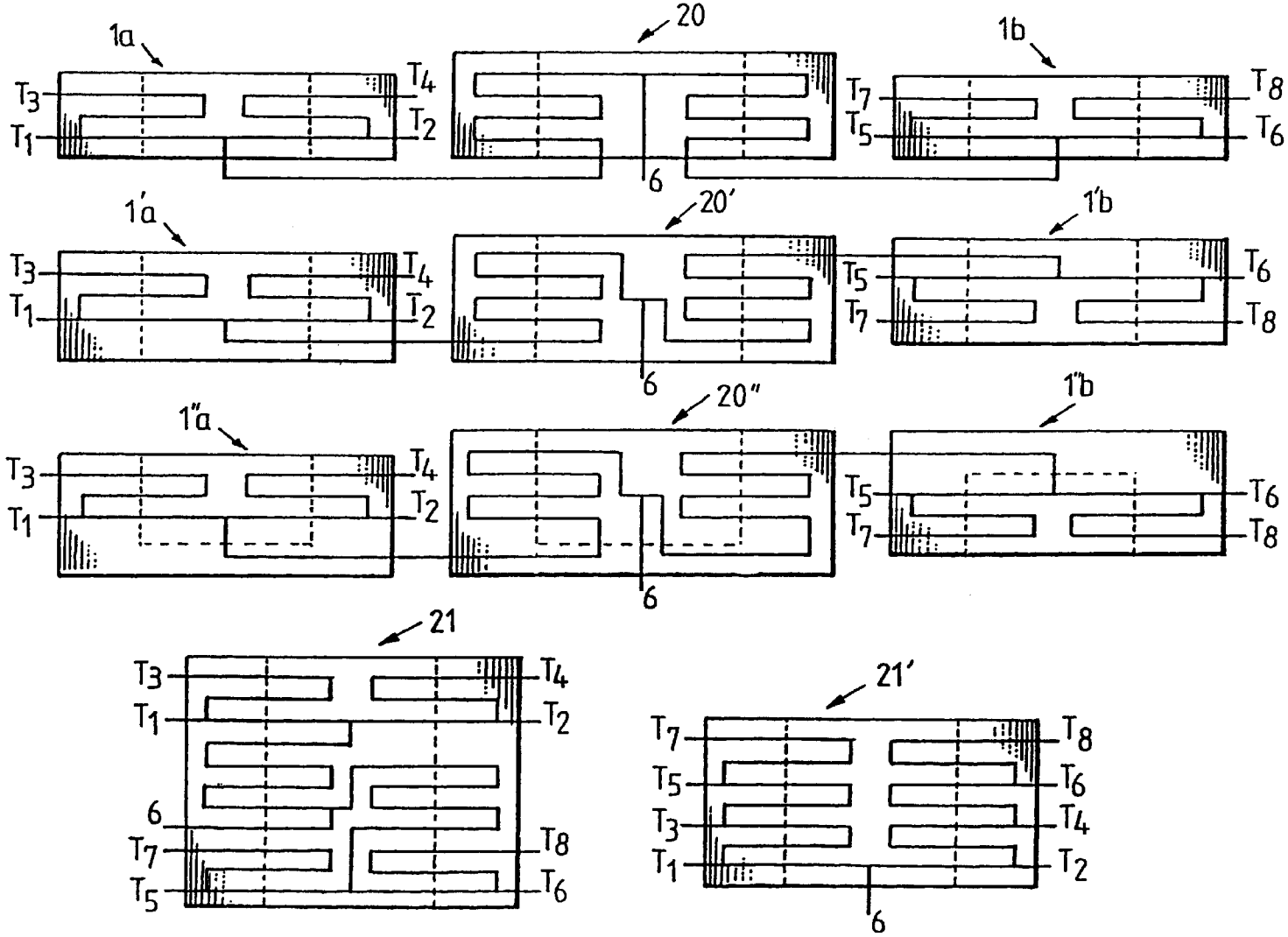
FIG. 2 illustrates, in schematic top plan views, various modifications of the feed line structure.

Of course, it is possible to modify the configuration of the feed line structure with meander-shaped loops. In FIG. 2, a number of such modified embodiments are shown.

In the first example (at the top of FIG. 2) there are three separate feed line structures, of which the structures 1*a* and 1*b* each correspond essentially to the embodiment shown in FIG. 1, whereas the central feed line structure 20 merely serves to feed the outer structures 1*a* and 1*b* with their respective terminals $T_1$, $T_2$, $T_3$, $T_4$, $T_5$, $T_6$, $T_7$, $T_8$. Element 6 represents the source connection terminal of FIG. 1.

The central areas (i.e., between the dashed vertical lines) of FIG. 2 depict the respective dielectric plates 5, and these three plates are mechanically coupled together so as to be moved in synchronism. In this way, eight antenna elements can be fed with eight different signal components derived from a common source signal.

The next two examples are slightly modified embodiments with outer and central structures 1'*a*, 1'*b*, 20' and 1"*a*, 1"*b* and 20", respectively. In the latter example, the dielectric plates are not as wide as the carrier plate. The central feed line structures 20', 20" feed outer structures 1'*a*, 1"*a* and 1'*b*, 1"*b* with their respective terminals $T_1$, $T_2$, $T_3$, $T_4$, $T_5$, $T_6$, $T_7$, $T_8$.

The variation possibilities are enormous, and at the bottom of FIG. 2 there are two further examples of feed line structures each feeding eight feed connection terminals $T_1$, $T_2$, $T_3$, $T_4$, $T_5$, $T_6$, $T_7$, $T_8$ with a single feed line structure 21 and 21', respectively.

FIGS. 3 and 4 serve to illustrate a mechanical actuator, by means of which the dielectric plate can be displaced by manual control. The feed line structure appears from FIG. 3 with a modified feed conductor line pattern 31, and from FIG. 4 with the carrier plate 32 (on which the feed conductor line pattern is deposited), the movable dielectric plate 33 and the stationary bottom plate 34.

As seen in FIG. 3, the dielectric plate 33 (see FIG. 4) is mechanically connected to a longitudinally guided rack 35 (also shown in FIG. 4), the linear movement of which is controlled by a gear mechanism, with gears 36 and 37, coupled to a rotatable axis 38 with a control knob 39. By manually turning the control knob 39, the rack 35 and the dielectric plate 33 can be longitudinally displaced to any desired position.

We claim:

1. A device for adjusting the beam direction of a beam radiated from a stationary array of antenna elements, wherein at least two antenna element feed points are coupled to a common signal source via a feed line structure having a source connection terminal connected to said source and at least two feed connection terminals connected to said antenna element feed points, said feed line structure comprising a feed conductor line pattern disposed in a fixed planar arrangement at a distance from and parallel to a fixed ground plate, and a movable dielectric body located therebetween, said movable dielectric body being displaceable parallel to said feed conductor line pattern and said ground plate so as to change an exciting phase of a signal component reaching one of said feed connection terminals, comprising;

said feed line pattern is elongated in a main direction, said dielectric body comprising a dielectric plate, which is displaceable in said main direction between two end positions, said feed line pattern includes longitudinal feed line segments extending parallel to said main direction towards each one of said feed connection terminals, portions of the feed line segments extending over the dielectric plate defining overlapping portions, said overlapping portions having a total length that remains constant as the dielectric plate is displaced, and said dielectric plate is located so as to extend, in any position between and including said end positions, in a region covering the overlapping portions of said longitudinal feed line segments, said overlapping portions effecting a controlled propagation velocity reduction of the corresponding signal components before the signal components reach the respective feed connection terminals.

2. The device as defined in claim 1, characterized in that said source connection terminal is located at a central portion of said feed line pattern, said feed connection terminals are located at end portions of said feed line pattern, and said dielectric plate extends in a region also covering said central portion of said feed line pattern.

3. The device as defined in claim 1, characterized in that said dielectric plate is substantially rectangular, and said feed conductor line pattern is meander-shaped, and said longitudinal feed line segments constitute a major part of the total length of the feed line segments in said feed conductor line pattern.

4. The device as defined in claim 3, characterized in that said feed conductor line pattern includes a meander-shaped portion on each side of a central portion including said source connection terminal, and each of the meander-shaped portions includes a respective longitudinal feed line segment leading to a corresponding one of said feed connection terminals, and at least one respective meander loop, which is branched off from said corresponding longitudinal feed line segment and includes at least two further longitudinal feed line segments leading to another one of said feed connection terminals.

5. The device as defined in claim 1, characterized in that said dielectric plate is displaceable into any desired position between and including each of said end positions by means of a mechanical actuator coupled to a manually operable control means for adjusting the beam direction.

6. The device as defined in claim 5, characterized in that said mechanical actuator comprises a longitudinally guided rack meshing with a gear mechanism coupled to a rotatable axis with a control knob.

7. The device as defined in claim 1, characterized in that the device comprises at least a second feed line structure and having a displaceable dielectric plate, which is displaceable in synchronism with the dielectric plate of a first one of the feed line structure.

8. A device as defined in claim 7, characterized in that the first feed line structure and the at least a second feed line structure are connected to said common signal source via a third feed line structure.

9. The device as defined in claim 1, characterized in that opposite end portions of said dielectric plate are provided with step-like recesses that minimize signal reflection in the corresponding portions of the feed line structure.

10. A feed line structure for adjusting the phase difference between at least two signal components derived from a radio frequency signal generated by a source, comprising a source connection terminal connected to the source and at least two feed connection terminals, and a feed conductor line pattern disposed in a fixed planar arrangement at a distance from and in parallel to a fixed ground plate, and a movable dielectric body located therebetween, said movable dielectric body being displaceable in parallel to said feed conductor line pattern and said ground plate so as to change an exciting phase of a signal component reaching one of said feed connection terminals, comprising:

said feed line pattern is elongated in a main direction, said dielectric body comprising a dielectric plate, which is displaceable in said main direction between two end positions, said feed line pattern includes longitudinal feed line segments extending parallel to said main direction towards respective ones of said feed connection terminals, portions of the feed line segments extending over the dielectric plate defining overlapping portions, said overlapping portions having a total length that remains constant as the dielectric plate is displaced, and said dielectric plate is located so as to extend, in any position between and including said end positions, in a region covering the overlapping portions of said longitudinal feed line segments, said overlapping portions effecting a controlled propagation velocity reduction of the corresponding signal components before the signal components reach the respective feed connection terminals.

11. A device for adjusting the beam direction of a beam radiated from a stationary array of antenna elements, wherein at least two antenna element feed points are coupled to a common signal source via a feed line structure having a source connection terminal connected to said source and at least two feed connection terminals connected to said antenna element feed points, said feed line structure comprising a feed conductor line pattern disposed in a fixed planar arrangement at a distance from and in parallel to a fixed ground plate, and a movable dielectric body located therebetween, said movable dielectric body being displaceable in parallel to said feed conductor line pattern and said ground plate so as to change an exciting phase of a signal component reaching one of said feed connection terminals, comprising:

said feed line pattern is elongated in a main direction, said dielectric body comprising a dielectric plate, which is displaceable in said main direction between two end positions, said feed line pattern includes longitudinal feed line segments extending parallel to said main direction towards each one of said feed connection terminals, portions of the feed line segments extending over the dielectric plate defining overlapping portions, said overlapping portions having a total length that remains constant as the dielectric plate is displaced, and said dielectric plate is located so as to extend, in any position between and including said end positions, in a region covering the overlapping supplementary portions of said longitudinal feed line segments, said, overlapping portions effecting a controlled propagation velocity reduction of the corresponding signal components before the signal components reach the respective feed connection terminals, said dielectric plate displaceable into any desired position between and including each of said end positions by means of a mechanical actuator coupled to a manually operable control means for adjusting the beam direction, and said mechanical actuator comprises a longitudinally guided rack meshing with a gear mechanism coupled to a rotatable axis with a control knob.

* * * * *